US007462047B2

(12) United States Patent
Tyler

(10) Patent No.: US 7,462,047 B2
(45) **Date of Patent: *Dec. 9, 2008**

(54) ELECTRICAL CONNECTOR ASSEMBLY WITH CONNECTION ASSIST

(75) Inventor: Adam P. Tyler, Rochester Hills, MI (US)

(73) Assignee: FCI Americas Technology, Inc., Carson City, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/803,566

(22) Filed: May 14, 2007

(65) Prior Publication Data

US 2007/0224862 A1 Sep. 27, 2007

Related U.S. Application Data

(63) Continuation of application No. 11/445,975, filed on Jun. 1, 2006, now Pat. No. 7,241,155.

(60) Provisional application No. 60/704,232, filed on Jul. 28, 2005.

(51) Int. Cl.
*H01R 13/62* (2006.01)

(52) U.S. Cl. ..... 439/157; 439/372

(58) Field of Classification Search ..... 439/153, 439/157, 188, 372; 200/51.1
See application file for complete search history.

(56) References Cited

U.S. PATENT DOCUMENTS

| | | | | |
|---|---|---|---|---|
| 3,495,206 | A | 2/1970 | Pfister | 339/64 |
| 4,332,432 | A | 6/1982 | Colleran | 439/157 |
| 4,684,190 | A | 8/1987 | Clark et al. | 439/587 |
| 4,778,395 | A | 10/1988 | Narita | 439/71 |
| 5,026,296 | A | 6/1991 | Hashiguchi | 439/159 |
| 5,110,301 | A | 5/1992 | Inoue et al. | 439/310 |
| 5,112,154 | A | 5/1992 | Milam | 403/13 |
| 5,171,156 | A | 12/1992 | Nagasaka et al. | 439/157 |
| 5,230,635 | A | 7/1993 | Takenouchi et al. | 439/157 |
| 5,244,400 | A | 9/1993 | Hatagishi | 439/157 |
| 5,269,696 | A | 12/1993 | Okada et al. | 439/140 |
| 5,279,506 | A | 1/1994 | Kawase et al. | 439/157 |
| 5,489,224 | A | 2/1996 | Schwarz | 439/752 |
| 5,564,935 | A | 10/1996 | Yagi et al. | 439/157 |
| 5,628,642 | A | 5/1997 | Bieringer et al. | 439/157 |
| 5,873,745 | A | 2/1999 | Duclos et al. | 439/157 |
| 5,921,791 | A | 7/1999 | Ono et al. | 439/157 |
| 5,924,880 | A | 7/1999 | Watanabe et al. | 439/157 |
| 5,928,012 | A | 7/1999 | Kitamura | 439/157 |
| 5,928,038 | A | 7/1999 | Berg et al. | 439/752 |
| 5,944,547 | A | 8/1999 | Golab et al. | 429/188 |

(Continued)

FOREIGN PATENT DOCUMENTS

| | | | |
|---|---|---|---|
| JP | 2005-174681 | A | 6/2005 |

(Continued)

*Primary Examiner*—Thanh-Tam T Le
(74) *Attorney, Agent, or Firm*—Harrington & Smith, PC

(57) ABSTRACT

An electrical connector including electrical contacts; a housing having the electrical contacts connected thereto; and a mate assist system for assisting in mating the electrical connector to a mating electrical connector. The mate assist system includes a cam member movably mounted to the housing having a slot for receiving a cam portion of the mating electrical connector and a rack section with teeth engaging a user actuatable member movably mounted to the housing.

22 Claims, 18 Drawing Sheets

U.S. PATENT DOCUMENTS

| | | | | |
|---|---|---|---|---|
| 5,954,528 | A | 9/1999 | Ono et al. | 439/157 |
| 5,975,929 | A | 11/1999 | Matsuura et al. | 439/157 |
| 6,036,510 | A * | 3/2000 | Ono et al. | 439/157 |
| 6,048,229 | A | 4/2000 | Lazaro, Jr. | 439/681 |
| 6,095,833 | A | 8/2000 | Osawa | 439/157 |
| 6,120,308 | A | 9/2000 | Hayashi | 439/157 |
| 6,126,470 | A | 10/2000 | Ono | 439/310 |
| 6,305,990 | B1 | 10/2001 | Ward | 439/752 |
| 6,352,433 | B2 | 3/2002 | Hayashi | 439/34 |
| 6,361,378 | B1 | 3/2002 | Konoya et al. | 439/752 |
| 6,375,481 | B2 | 4/2002 | Zweigle | 439/157 |
| 6,475,004 | B2 | 11/2002 | Shuey et al. | 439/157 |
| 6,514,098 | B2 | 2/2003 | Marpoe, Jr. et al. | 439/352 |
| 6,540,532 | B1 * | 4/2003 | Martin et al. | 439/157 |
| 6,599,153 | B2 | 7/2003 | Nishide | 439/681 |
| 6,612,854 | B2 * | 9/2003 | Takata | 439/157 |
| 6,705,882 | B2 | 3/2004 | Casses | 439/157 |
| 6,960,090 | B2 | 11/2005 | Denter et al. | 439/157 |
| 6,997,725 | B2 | 2/2006 | Stella et al. | 439/157 |
| 7,241,155 | B2 * | 7/2007 | Tyler | 439/157 |
| 2001/0012710 | A1 | 8/2001 | Kumakura et al. | 439/157 |
| 2002/0022391 | A1 | 2/2002 | Beck, Jr. et al. | 439/157 |
| 2002/0081877 | A1 | 6/2002 | Ohnuki | 439/157 |
| 2002/0127912 | A1 | 9/2002 | Hamai et al. | 439/587 |
| 2002/0182908 | A1 | 12/2002 | Maegawa | 439/157 |
| 2003/0003786 | A1 | 1/2003 | Bakker et al. | 439/157 |
| 2004/0192090 | A1 | 9/2004 | Flowers et al. | 439/157 |

FOREIGN PATENT DOCUMENTS

| | | |
|---|---|---|
| JP | 2006-278109 A | 12/2006 |

* cited by examiner

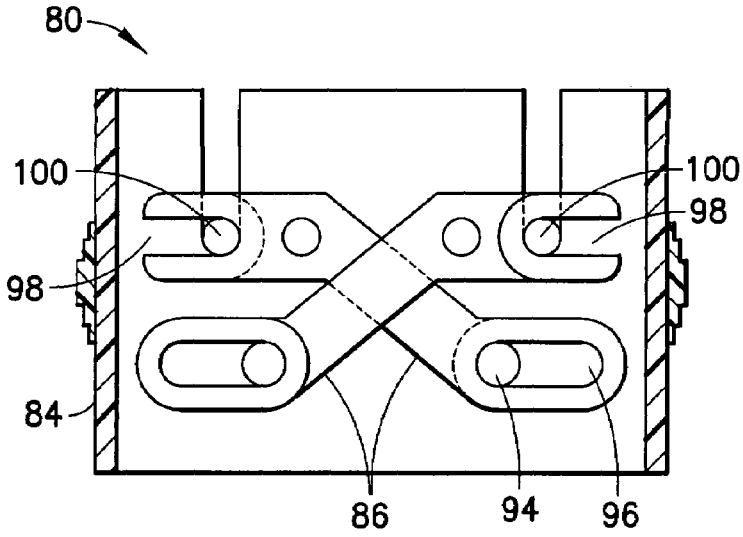
FIG.13
FIG.17
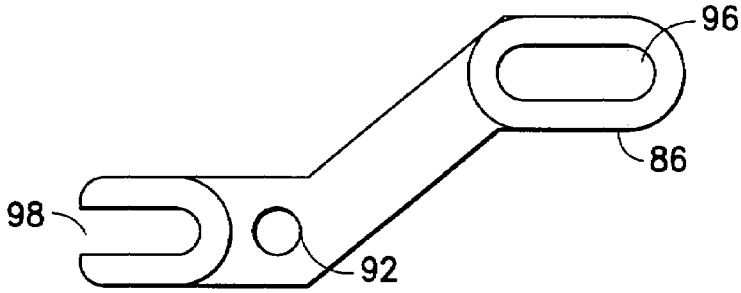
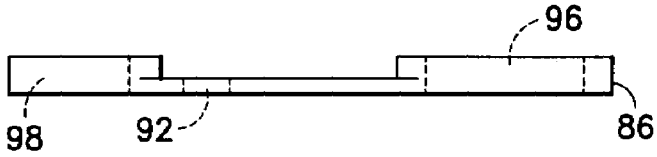
FIG.18

ELECTRICAL CONNECTOR ASSEMBLY WITH CONNECTION ASSIST

CROSS REFERENCE TO RELATED APPLICATION

This is a continuation patent application of U.S. patent application Ser. No. 11/445,975 filed Jun. 1, 2006 now U.S. Pat. No. 7,241,155, which claims priority under 35 U.S.C. §119(e) on U.S. provisional patent application No. 60/704,232 filed Jul. 28, 2005 which is hereby incorporated by reference in its entirety.

BACKGROUND OF THE INVENTION

1. Field of the Invention

The invention relates to an electrical connector and, more particularly, to a system for mating two electrical connectors with each other.

2. Brief Description of Prior Developments

U.S. Pat. No. 6,120,308 discloses an electrical connector assembly which can be rotatably connected and disconnected.

SUMMARY OF THE INVENTION

In accordance with one aspect of the invention, an electrical connector is provided including electrical contacts; a housing having the electrical contacts connected thereto; and a mate assist system for assisting in mating the electrical connector to a mating electrical connector. The mate assist system includes a cam member movably mounted to the housing having a slot for receiving a cam portion of the mating electrical connector and a rack section with teeth engaging a user actuatable member movably mounted to the housing.

In accordance with another aspect of the invention, an electrical connector is provided comprising electrical contacts; a housing having the electrical contacts connected thereto; and a mate assist system for assisting in mating the electrical connector to a mating electrical connector. The mate assist system comprises at least two lever arms pivotably connected to the housing. Each lever arm comprises a slot for receiving at least one cam portion of the mating electrical connector. The lever arms at least partially cross each other.

In accordance with another aspect of the invention, an electrical connector is provided comprising a housing; a plurality of electrical contacts connected to the housing; at least one shorting bar connected to the housing and movably connected to the electrical contacts; a slide slidably mounted to the housing, wherein the slide comprises a first rack section with teeth; and a cam member pivotably mounted to the housing having a slot for receiving a cam portion of a mating electrical connector. The cam member comprises a second rack section with teeth engaging the teeth of the first rack section.

BRIEF DESCRIPTION OF THE DRAWINGS

The foregoing aspects and other features of the invention are explained in the following description, taken in connection with the accompanying drawings, wherein:

FIG. 13 is a top plan view with a cut away of an alternate embodiment of the invention;

FIG. 17 is a top plan view of one of the lever arms of the connector shown in FIG. 13;

FIG. 18 is a side elevational view of the lever arm shown in FIG. 17;

DETAILED DESCRIPTION OF THE PREFERRED EMBODIMENTS

Figure 1:
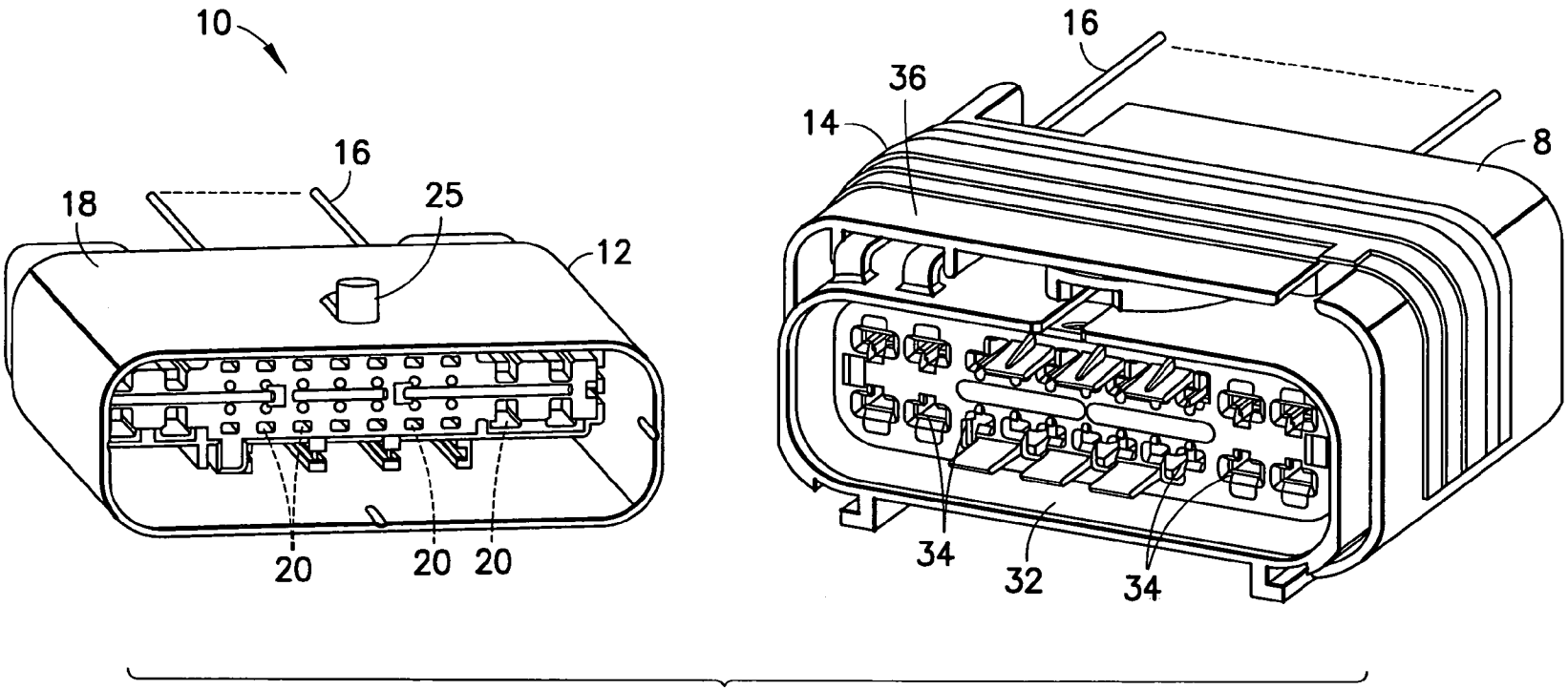
FIG. 1 is an exploded perspective view of two electrical connectors used to form an electrical connector assembly.

Referring to FIG. 1, there is shown an exploded perspective view of an electrical connector assembly 10 incorporating features of the invention. Although the invention will be described with reference to the exemplary embodiments shown in the drawings, it should be understood that the invention can be embodied in many alternate forms of embodiments. In addition, any suitable size, shape or type of elements or materials could be used.

The assembly 10 generally comprises a first electrical connector 12, a second electrical connector 14 and electrical conductors 16, such as wires, connected to the electrical connectors 12, 14. The two electrical connectors 12, 14 are adapted to removably mate with each other to electrically connected their respective wires 16 to each other. The first electrical connector 12 generally comprises a housing 18, electrical contacts 20 and a mat wire seal 27 (see FIGS. 2A and 2B). The mat wire seal 27 forms seals and strain relief for the wires 16 entering the rear of the connector 12. The seal 27 is located between the rear end of the outer housing member 24 and the rear end of the inner housing member 22. The seal has holes to allow wires to pass through the seal and which makes a sealing contact with the wires.

Figure 2:
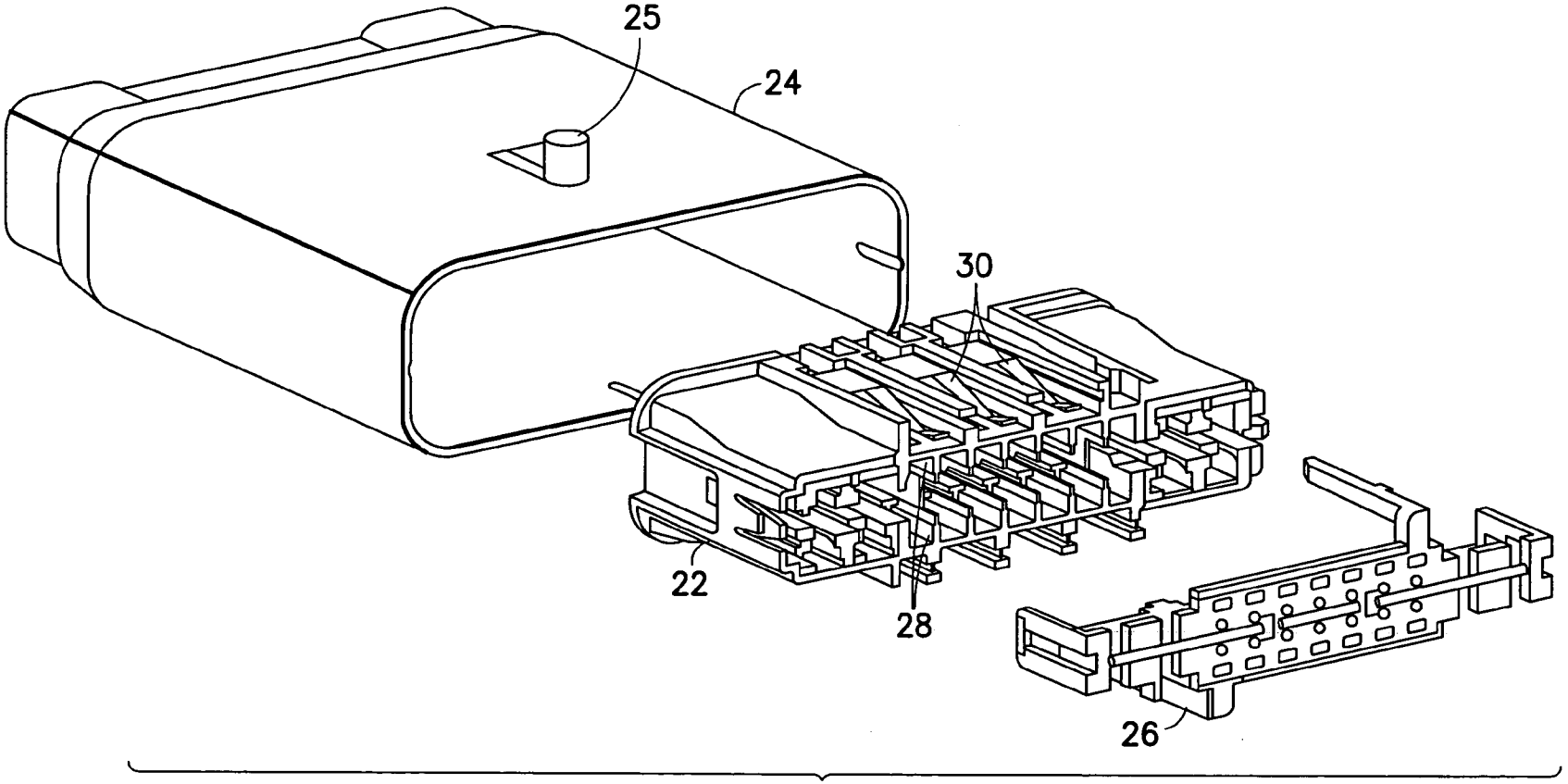
FIG. 2 is an exploded perspective view of some components of a first one of the electrical connectors shown in FIG. 1.

Referring also to FIG. 2, the housing 18 generally comprises an inner housing member 22, an outer housing member 24, and a combined terminal position assurance (TPA) and primary lock reinforcement (PLR) (TPA/PLR) member 26. The electrical contacts 20 are mounted in contact receiving channels 28 inside the inner housing member 22. The contacts 20 are crimped or otherwise connected to the wires 16 of the first connector 12. The inner housing member 22 is stationarily mounted inside the outer housing member 24. The TPA/PLR member 26 is movably mounted on the front end of the inner housing member 22. The inner housing 22 has locking latches at the receiving channels 28 for latching the electrical contacts 20 in the receiving channels 28. After the electrical contacts 20 are inserted into the receiving channels 28 of the inner connector housing 22, the TPA/PLR member 26 is pushed rearward on the inner housing 22 to reinforce the electrical contact locking latches. However, in alternate embodiments any suitable type of inner housing could be provided and any suitable type of terminal position assurance and primary lock reinforcement could be provided.

Figure 3:
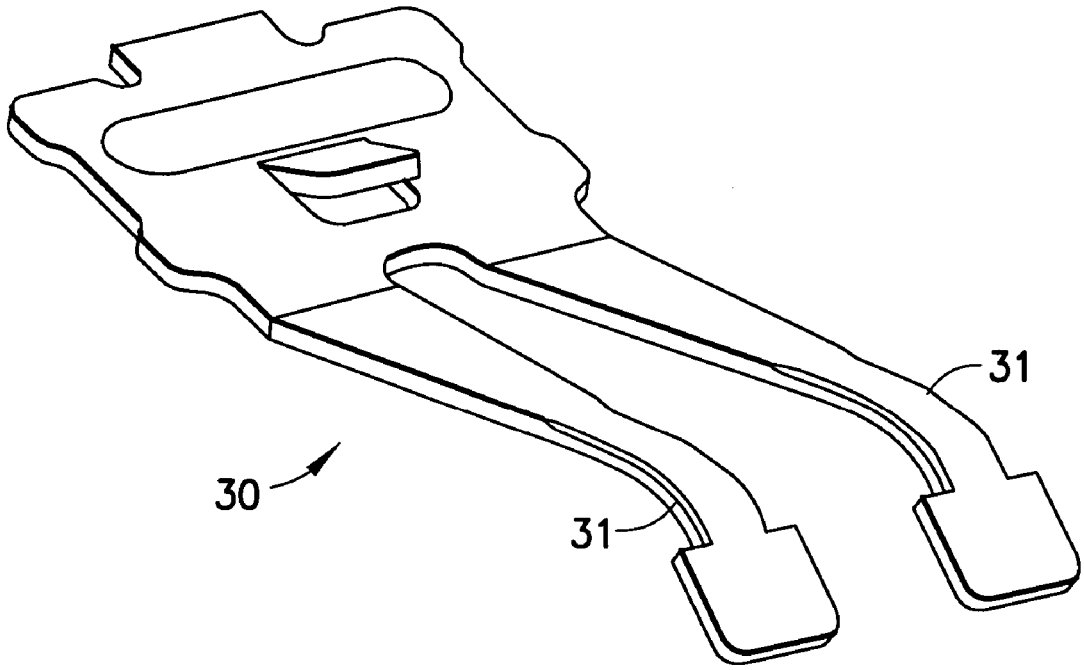
FIG. 3 is a perspective view of the shoring bat used in the connector shown in FIG. 2.

Referring also to FIG. 3, the first connector 12 includes electrical shorting bar contacts 30 mounted on the inner housing member 22. The shorting bar contacts electrically connect pairs of the electrical connectors 20 to each other before the second connector 14 is mated with the first connector 12. However, during mating of the second connector 14 with the first connector 12, the second connector 14 has projections 44 which are adapted to move the contact arms 31 of the shorting bar contacts 30 off of connection with the contacts 20. In an alternate embodiment the shorting bars might not be provided.

Figure 2A:
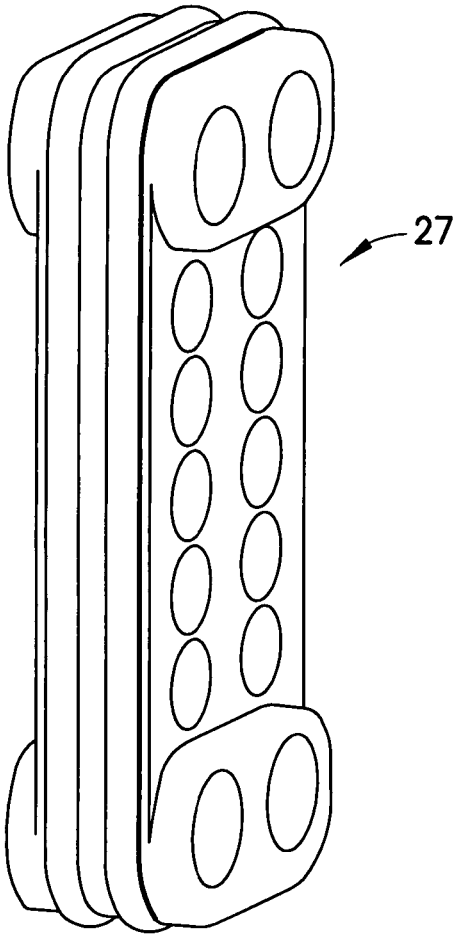
FIG. 2A is a perspective view of a mat wire seal used in the electrical connector shown in FIG. 2.
Figure 2B:
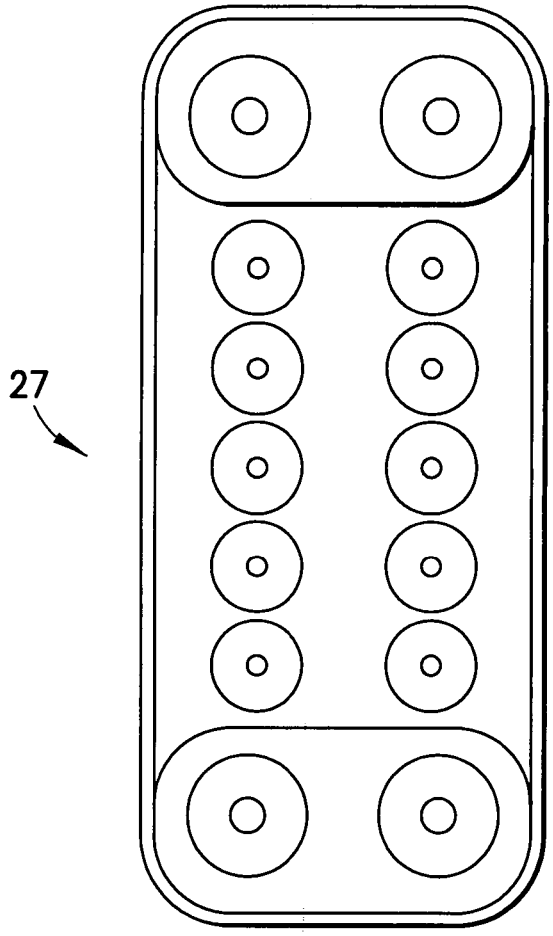
FIG. 2B is a front elevational view of the mat wire seal shown in FIG. 2A.
Figure 4:
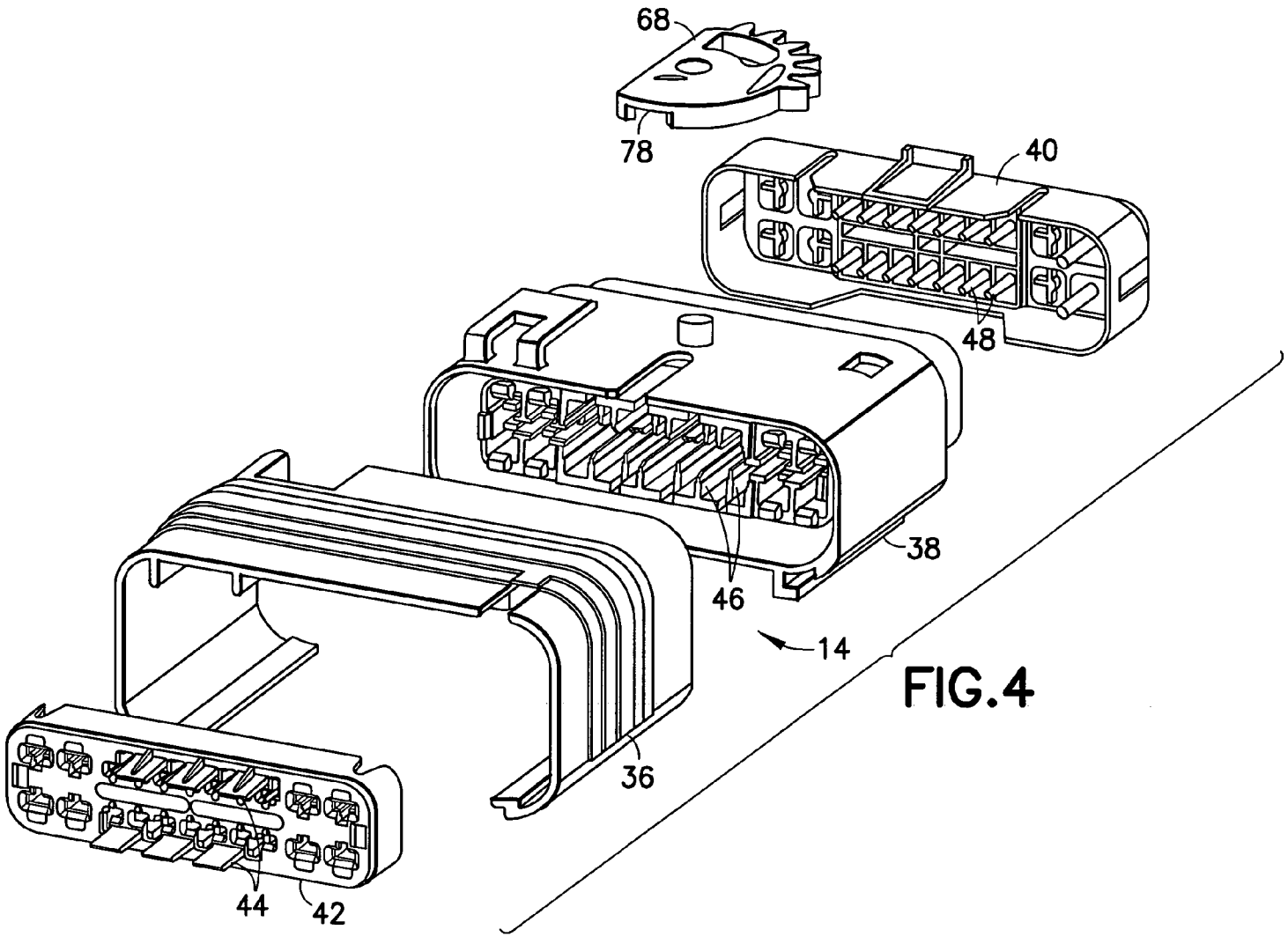
FIG. 4 is an exploded perspective view of some components of the second electrical connector shown in FIG. 1.

As seen in FIG. 1, the second electrical connector generally comprises a housing 32, electrical contacts 34 and a slide 36. Referring also to FIG. 4, the housing 32 generally comprises a main housing member 38, a rear end seal cover 40 and a front end combined terminal position assurance (TPA) and primary lock reinforcement (PLR) (TPA/PLA) member 42. The TPA/PLR member 42 is mounted to the front end of the main housing member 38, such as with a snap lock connection for example. The TPA/PLR member 42 includes forward projecting isolators 44 which are adapted to move the contact arms 31 of the shorting bar contacts 30 off of connection with the contacts 20 when the second electrical connector 14 is connected to the first electrical connector 12. A mat wire seal (not shown) similar to the seal 27 shown in FIGS. 2A and 2B is located between the rear end of the main housing member 38 and the rear end seal cover 40. A perimeter seal (not shown) is also provided on the second connector 14 to form a seal with the housing of the first connector 12. However, in alternate embodiments, any suitable structure(s) could be provided for the housing component(s) of the second connector 14.

Figure 5:
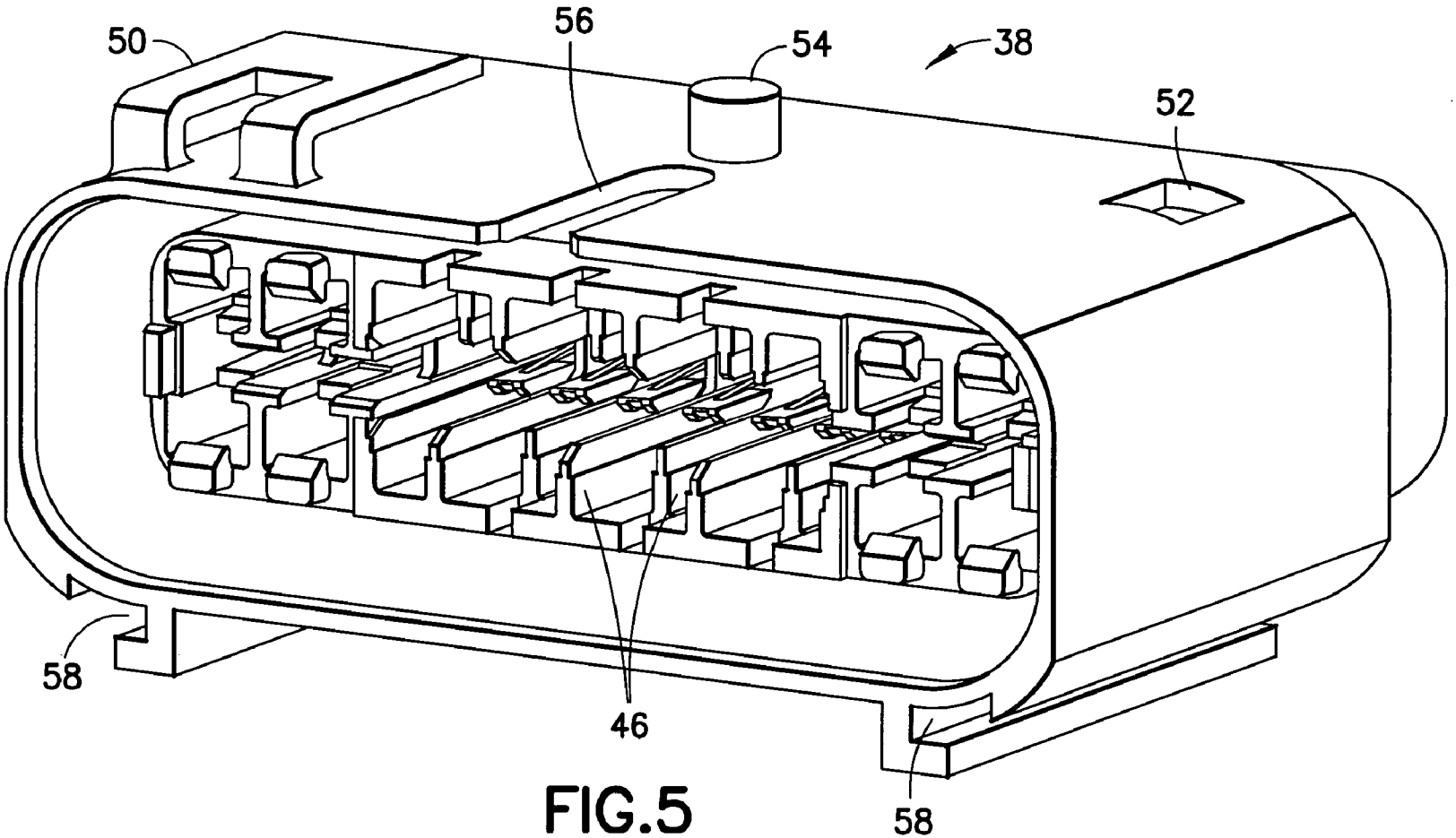
FIG. 5 is a perspective view of a main housing member of the connector shown in FIG. 4.

Referring also to FIG. 5, the main housing member 38 comprises contact receiving areas 46. The electrical contacts 34 are mounted in the receiving areas 46. The main housing member 38 comprises latches for latching the contacts 34 in the receiving areas 46. The TPA/PLR member 42, when moved to a locked position on the main housing member 38, strengthens the latches to prevent inadvertent withdrawal of the contacts 34 from the main housing member 38. A top side of the main housing member 38 comprises a first deflectable latch 50, a second latch receptacle 52, a pivot pin 54 and a slot 56. The bottom side of the main housing member 38 comprises two slide slots 58.

The rear end seal cover 40 is mounted to the rear end of the main housing member 38, such as with a snap lock connection for example. The rear seal cover 40 includes wire strain relief tubes 48. The wires 16 of the second connector 14 extend through the wire strain relief tubes 48 of the rear seal cover 40 and into the receiving areas 46.

Figure 6:
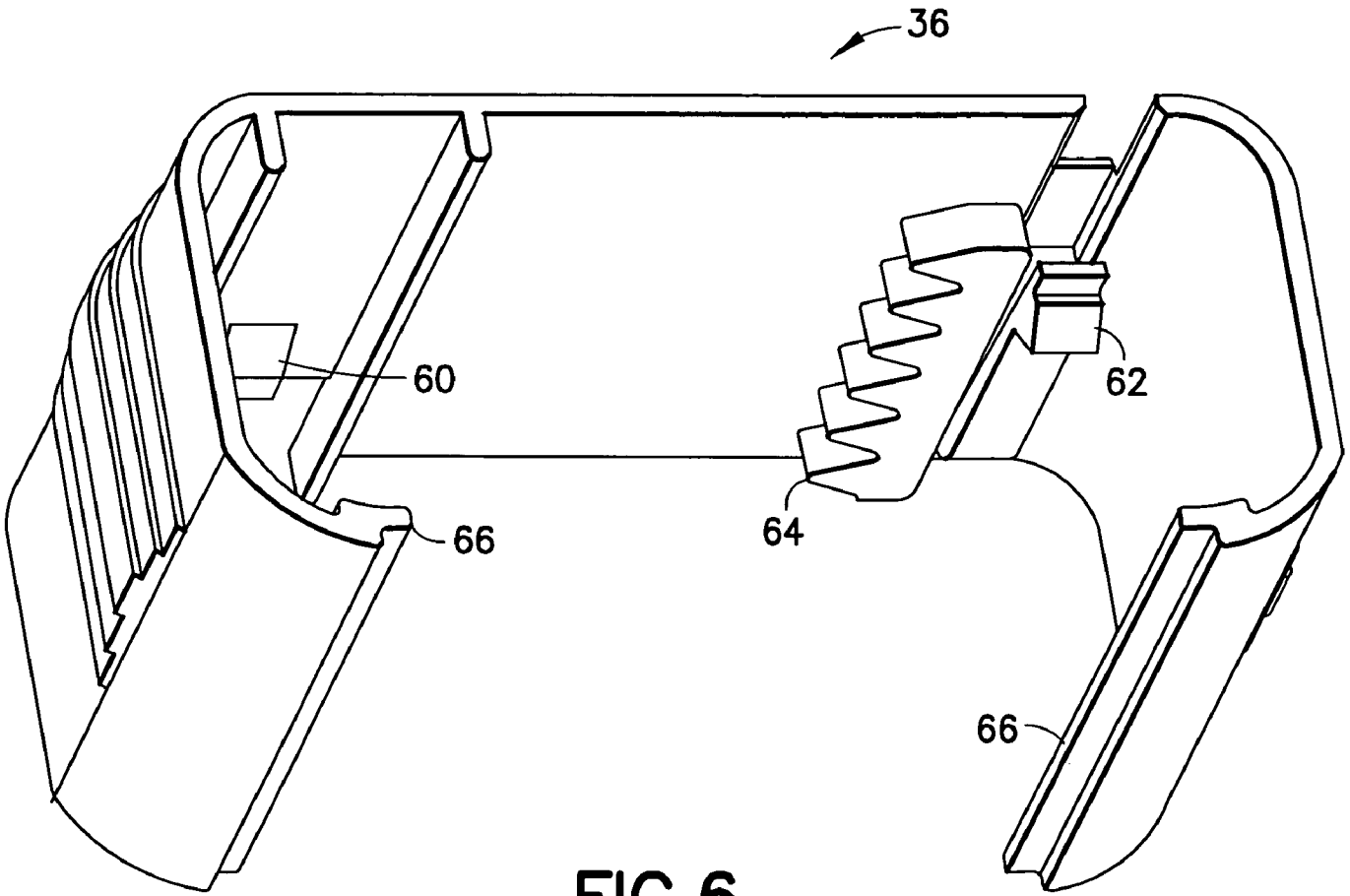
FIG. 6 is a perspective view of the slide of the connector shown in FIG. 4.

Referring also to FIG. 6, the slide 36 comprises a top with a first latch 60, a second latch 62, and a rack of teeth 64 located on the interior facing side of the top. The bottom of the slide 36 has slide feet 66. The feet 66 are sized and shaped to be received in the slide slots 58 of the main housing member 38 and slide therealong. The slide 36 is sized and shaped to be mounted over and substantially surround the main housing member 38. The slide 36 can slide along the main housing member between a rear position and a forward position.

When the slide is moved to the forward position by a user, the first latch 60 is adapted to latch with the first deflectable latch 50 to retain the slide 36 at a forward position on the main housing member 38. Thus, the first latch 60 and the first deflectable latch 50 form a first latch system. The second latch 62 is adapted to engage the second latch receptacle 52 to retain the slide 36 at the retracted rear position on the main housing member 38 until positively moved by a user. Thus, the second latch 62 and the second latch receptacle 52 form a second latch system.

Figure 7:
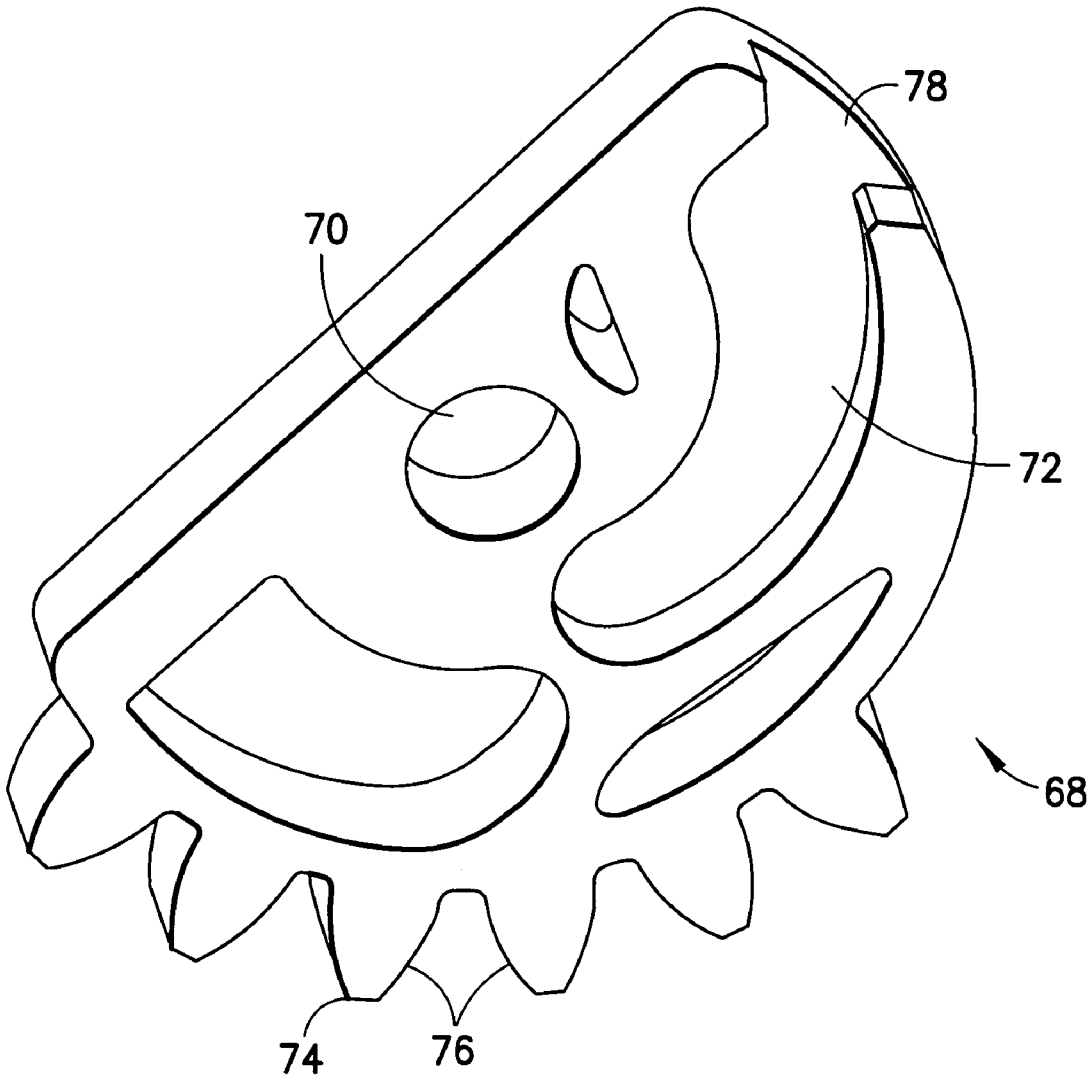
FIG. 7 is a perspective view of the combined pinion gear and cam member shown in FIG. 4.
Figure 8:
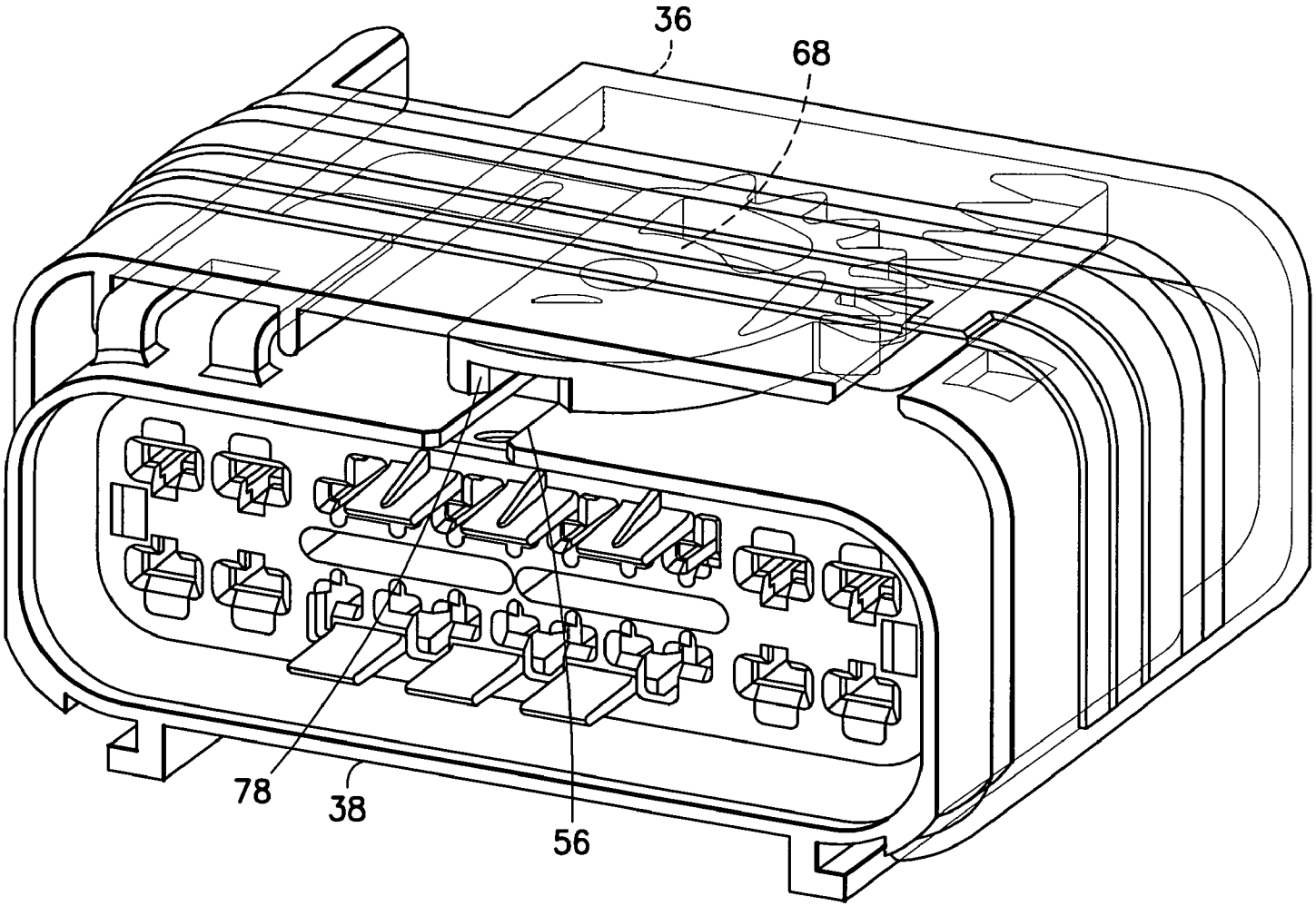
FIG. 8 is a perspective view of the connector shown in FIG. 4 with the slide in a rearward position.
Figure 10:
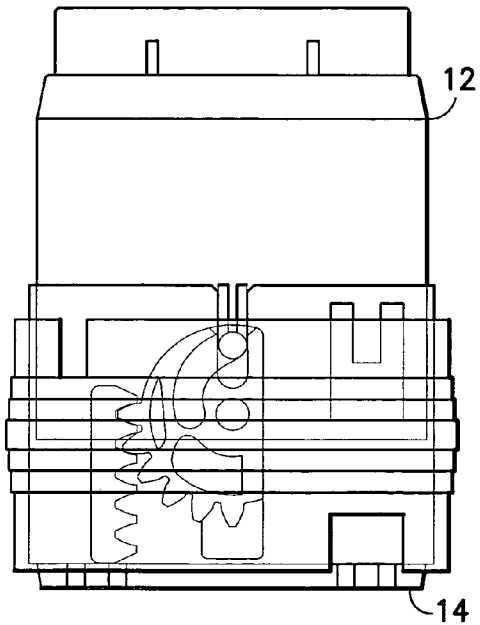
FIG. 10 is a top plan view as in FIG. 9 with the two connectors initially connected to each other.
Figure 9:
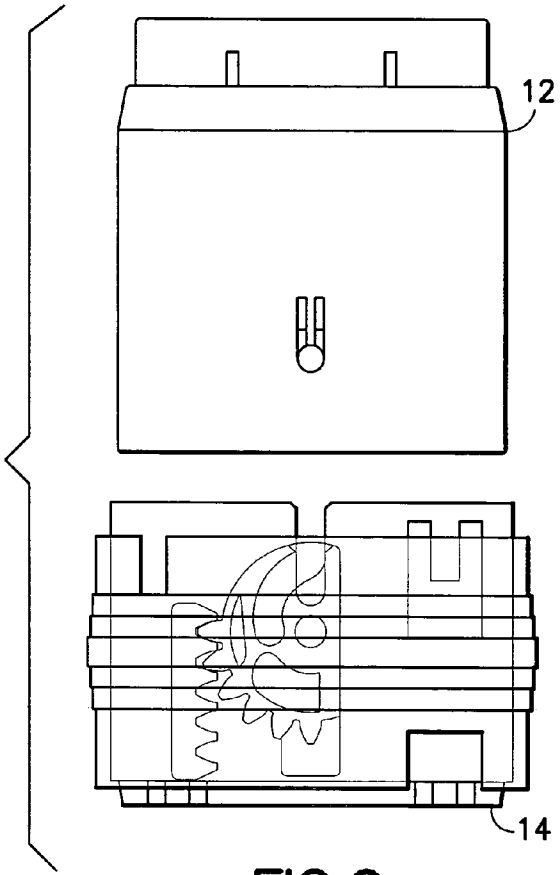
FIG. 9 is a top plan view of the two connectors shown in FIG. 1 about to be connected to each other.

Referring also to FIGS. 7 and 8, the second connector 14 also comprises a combined pinion gear and cam member 68. FIG. 8 shows the slide 36 at its rear home position. FIG. 8 also shows the member 68 at its corresponding home position. The member 68 comprises a pivot hole 70, a pin slot 72, and a gear section 74 with teeth 76. The member 68 is rotatably mounted on the main housing member 38 with the pivot pin 54 located in the pivot hole 70. The teeth 76 are adapted to intermesh with the teeth 64 of the rack section on the slide 36. The pin slot 72 has a general curved shape in this embodiment. The pin slot 72 has an entrance 78 that is aligned with the slot 56 when the member 68 is at a home position on the main housing member 38. The slot 56 has a general straight shape in this embodiment.

The slot 56 and pin slot 72 are adapted to receive the mounting pin 25 (see FIGS. 1 and 2) of the first connector 12 when the first and second connectors are attached to each other. The mounting pin 25 is sized and shaped to slide along the slot 56. The member 68 is adapted to rotate to assist in moving the pin 25 along the length of the slot 56; functioning as a cam and mate assist. More specifically, and referring also to FIGS. 9-12, the user can grasp the slide 36 during connection of the two connectors 12, 14 to each other. When the housing of the first connector 12 is inserted into the second connector 14, the latching by the second latch 62 and second latch receptacle 52 is overcome because the housing 24 moves the second latch 62. The slide 36 can then begin to slide forward on the main housing member 38. Thus, the slide 36 is freed to move when the slide latch 62 is deflected free and disengaged from the latch window 52 by the leading edge of the opposing connector 12 outer housing 24.

Figure 12:
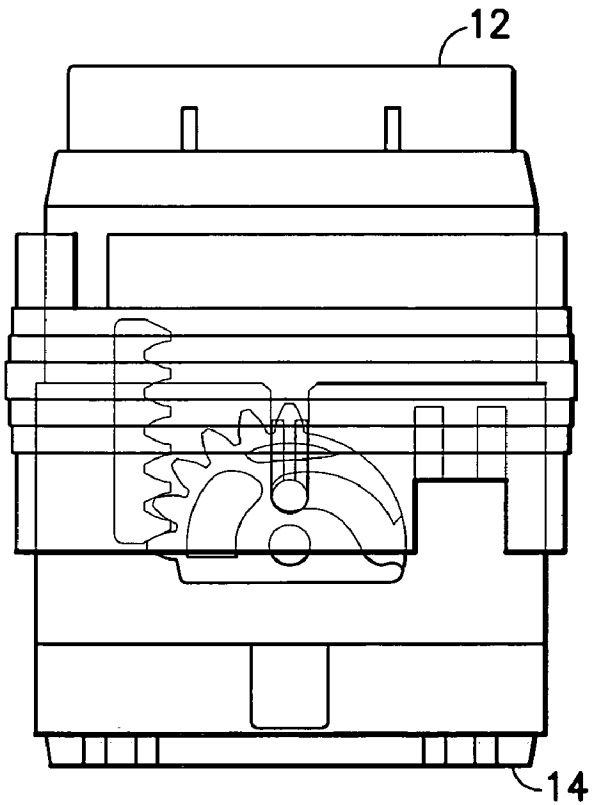
FIG. 12 is a top plan view as in FIG. 11 with the two connectors connected to each other at a final connection position.
Figure 11:
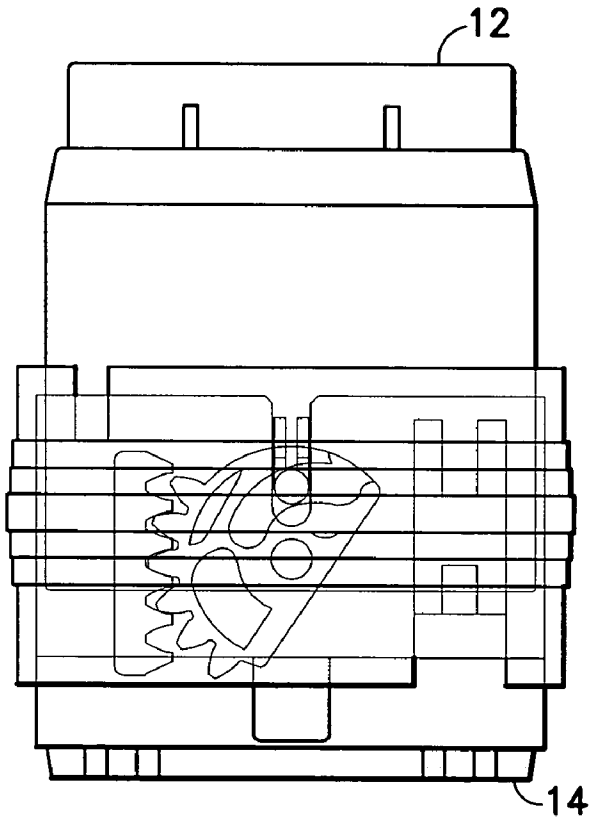
FIG. 11 is a top plan view as in FIG. 10 with the two connectors further connected to each other.
Figure 14:
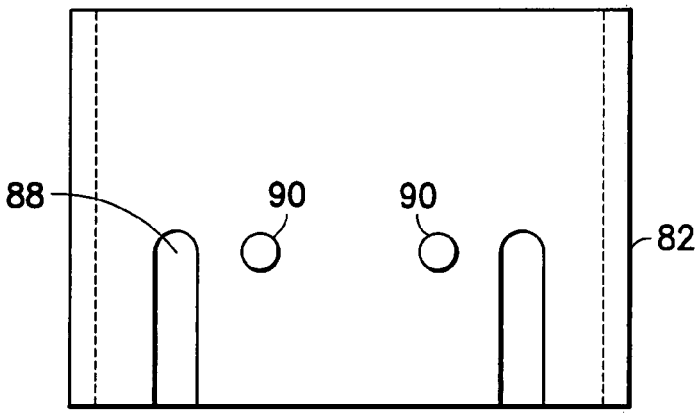
FIG. 14 is a top plan view of the housing of the connector shown in FIG. 13.
Figure 15:
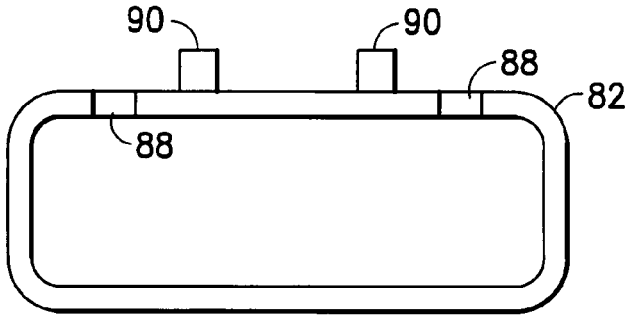
FIG. 15 is a front elevational view of the housing of the connector shown in FIG. 13.
Figure 16:
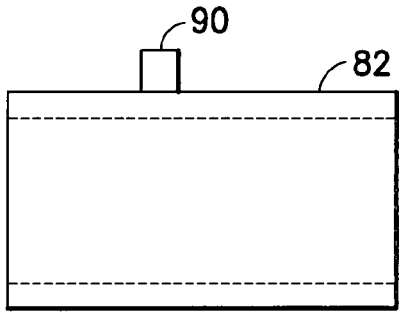
FIG. 16 is a side elevational view of the housing of the connector shown in FIG. 13.
Figure 19:
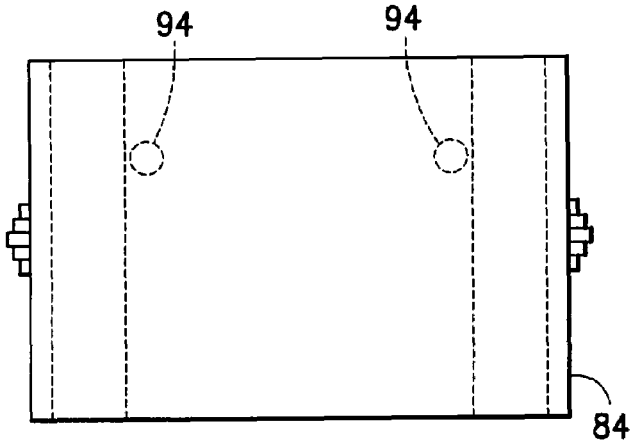
FIG. 19 is a top plan view of the slide of the connector shown in FIG. 13.
Figure 20:
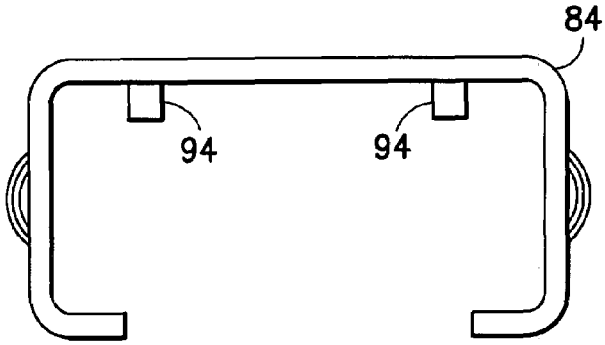
FIG. 20 is a front elevational view of the slide shown in FIG. 19.
Figure 21:
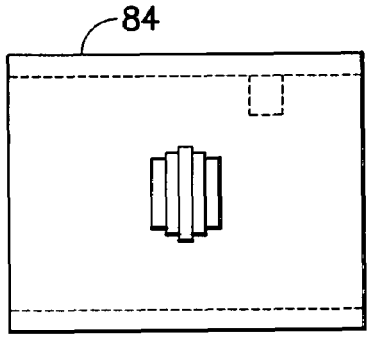
FIG. 21 is a side elevational view of the slide shown in FIG. 19.
Figure 22:
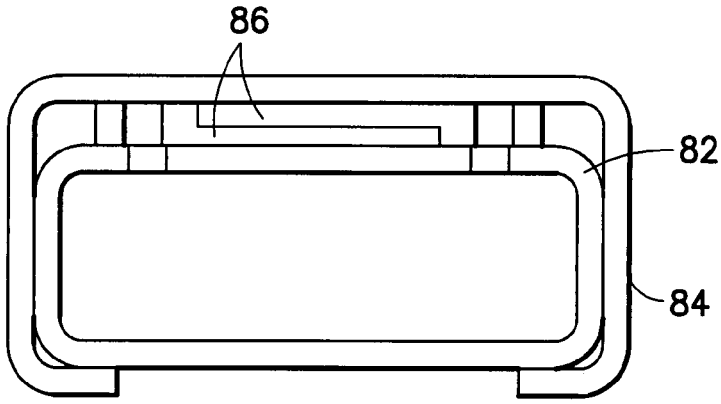
FIG. 22 is a front elevation view of the connector shown in FIG. 13.

As the slide 36 is moved forward on the main housing member 38, this causes the rack of teeth 64 on the slide 36 to rotate the member 68 because of the intermeshed nature of the teeth 76, 64 as seen in FIG. 11. As the member 68 rotates it cams the pin 25 to move deeper into the length of the slot 56. The pin slot 72 cams against the pin 25 to help move the two connectors 12, 14 into their final connected position with each other as seen in FIG. 12. The first latch 60 engages the first deflectable latch 50 to keep the slide 36 at its forward position on the main housing member 38 and, thus, keep the first and second connectors 12, 14 at their final connected position shown in FIG. 12.

To disconnect the two connectors 12, 14, the latch system 50, 60 is disengaged by the user and the slide 36 is moved to its rearward position. The intermeshing teeth 64, 76 cause the member 68 to rotate while the slide 36 is moved to eject the pin 25, at least partially, from the slot 56. Thus, the invention can also be used to assist in disconnecting the two connectors 12, 14.

Referring now to FIGS. 13-22 another embodiment of the invention is shown. In this embodiment the electrical connector 80 comprises a housing 82, a mate-assist sleeve or slide 84 and two mate-assist lever arms 86. The housing 82 comprises a top side with two pin receiving slots 88 and two pivot posts 90. The two lever arms 86 are pivotably mounted on the pivot posts 90 at holes 92. As seen in FIG. 13, the lever arms 86 cross each other. Slide 84 is mounted over the housing 82. The slide 84 comprises inwardly extending posts 94. The posts are located in the slots 96 of the lever arms 86. The lever arms 86 also comprise open ended slots 98. The open ended slots 98 are aligned with the slots 88 to receive and capture pins 100 of a mating connector as seen in FIG. 13. When the slide 84 is moved relative to the housing 82, the slide 84 causes the lever arms 86 to move on the housing, similar to a scissors action. This positions the lever arms 86 to receive the pins 100 when the slide is in a rearward position, and cam the pins 100 into the slots 88 of the housing 82 as the slide is moved forward on the housing. This type of embodiment may be particularly advantageous for connectors having longer widths, and/or helping to use a balanced, multi-point applied system to smaller size connectors.

Figure 23:
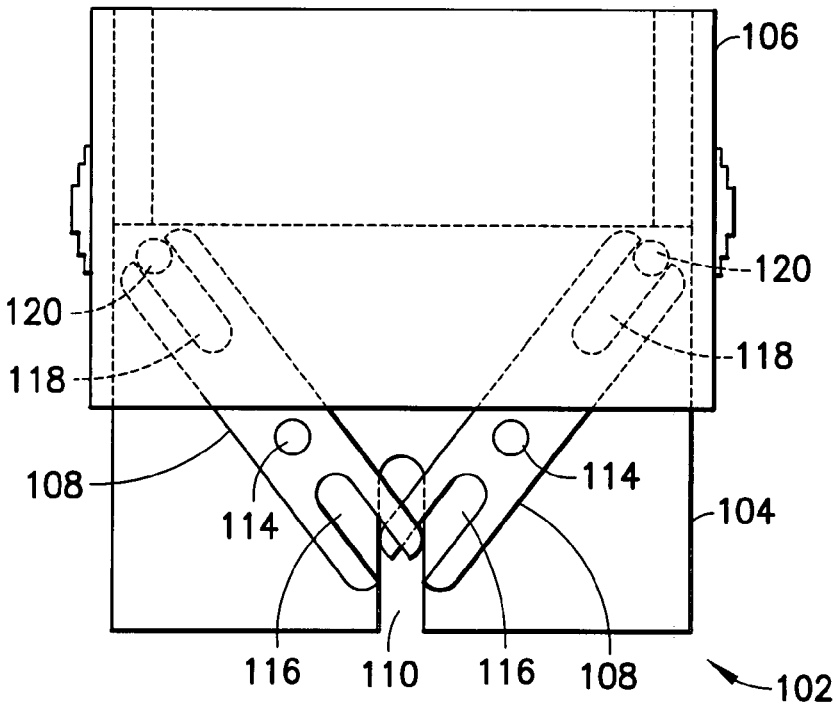
FIG. 23 is a top plan view of an alternate embodiment of a connector comprising features of the invention.
Figure 24:
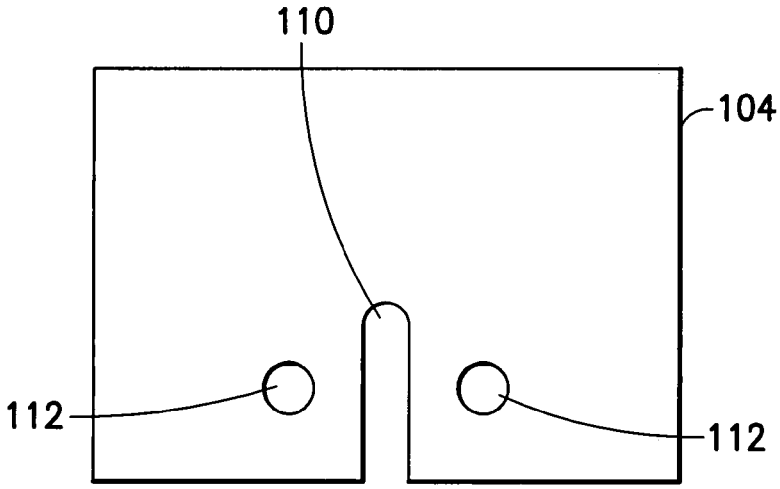
FIG. 24 is a top plan view of the housing of the connector shown in FIG. 23.

Referring now to FIGS. 23-24 another embodiment is shown. In this embodiment the connector 102 comprises a housing 104, a slide 106 and two lever arms 108. The housing 104 comprises a mating connector pin receiving slot 110 and two pivot posts 112. The lever arms 108 each comprise pivot holes 114 and two open ended slots 116, 118. The lever arms 108 are pivotably mounted on the pivot posts 112 at the holes 114 and at least partially cross each other. The slide 106 has two inwardly facing posts 120. The posts 120 are located in the slots 118. The slots 116 are aligned with the slot 110. The mounting pin for the mating electrical connector (not shown) can be received in the slot 110 with the slide 106 moving the lever arms 108 to cam the mounting pin of the mating electrical connector into the slot 110.

Figure 25:
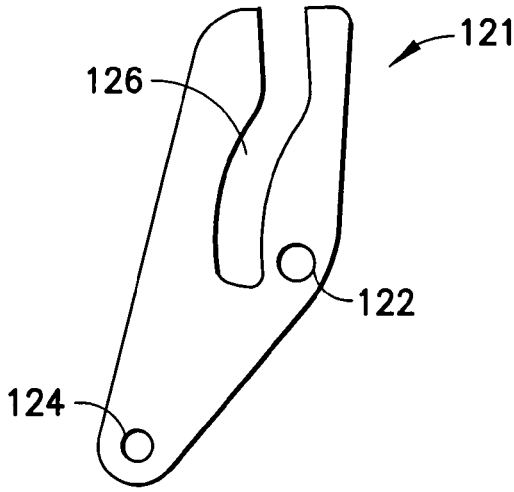
FIG. 25 is a top plan view of an alternate embodiment of a lever arm.
Figure 26:
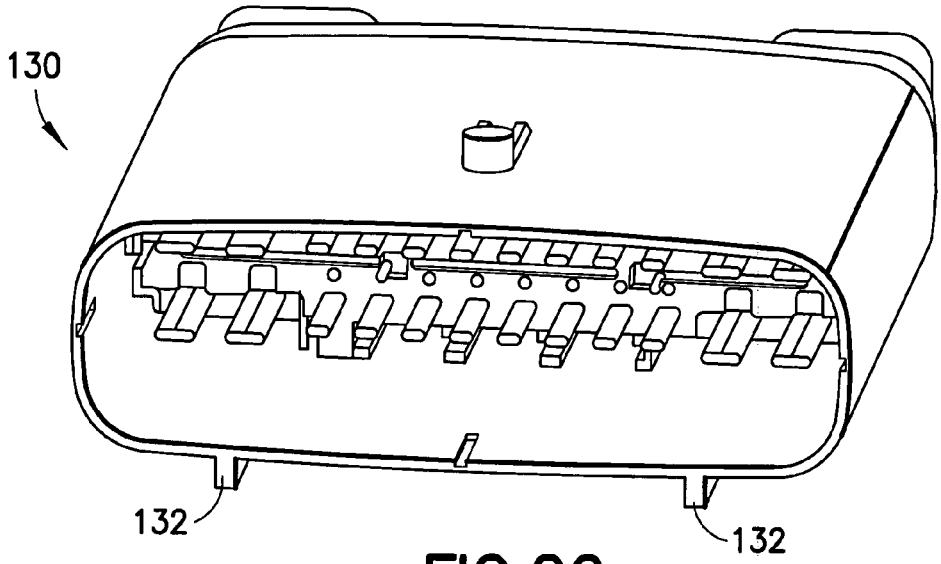
FIG. 26 is perspective view of an alternate embodiment of the first electrical connector.
Figure 27:
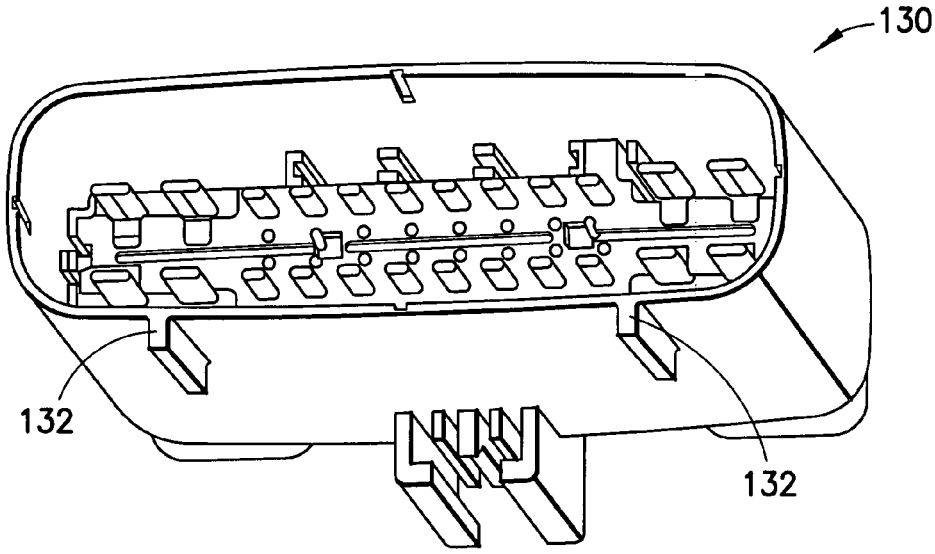
FIG. 27 is another perspective view of the first electrical connector shown in FIG. 26.
Figure 28:
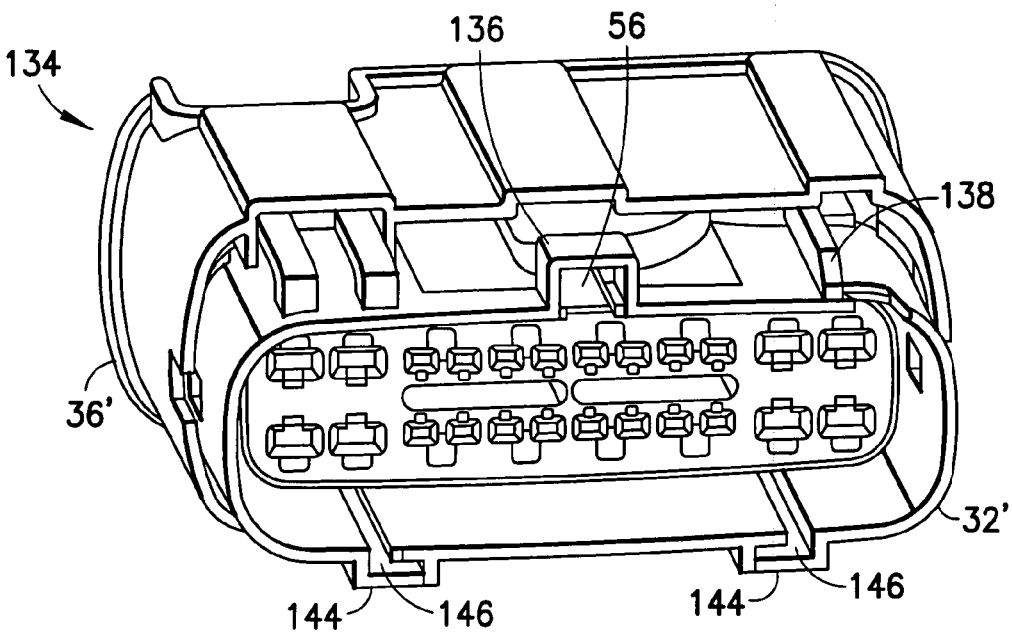
FIG. 28 is a perspective view of another alternate embodiment of the second electrical connector for use with the first electrical connector shown in FIGS. 26-27.
Figure 29:
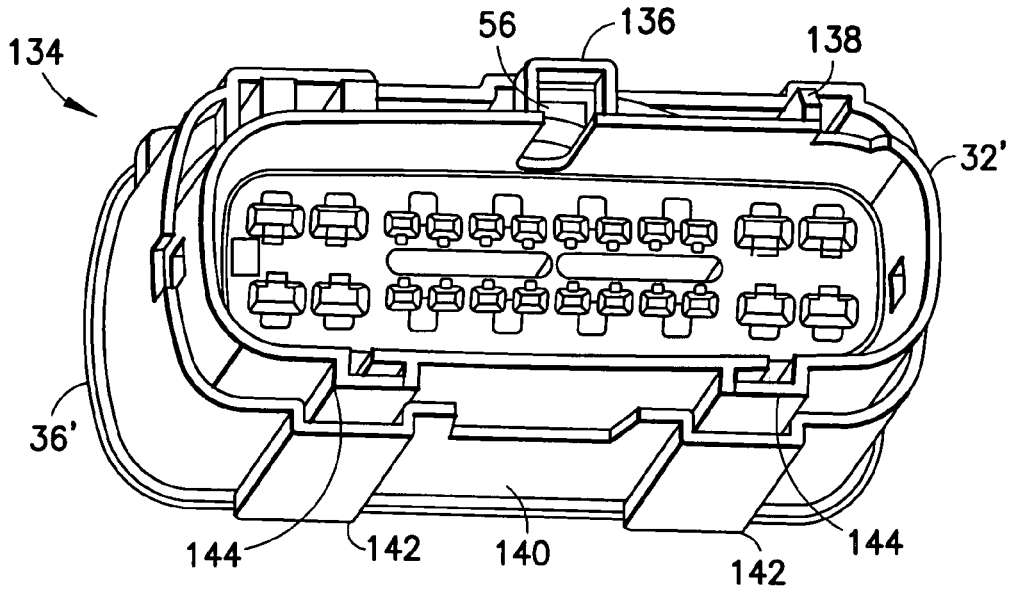
FIG. 29 is another perspective view of the second electrical connector shown in FIG. 28.

FIG. 25 shown an alternate shape of a lever arm 121 with a pivot hole 122, a post 124 and a cam slot 126'. However, any suitable shape could be provided.

In an alternate embodiment a housing/TPA/seal cover design strategy on the male housing could be used as opposed to the outer-housing/inner-housing/TPA strategy that is shown. In another embodiment a connector without shorting bars could be provided.

Referring also to FIGS. 26-29 an alternate embodiment of the electrical connector assembly is shown. In this embodiment the first electrical connector 130 is identical to the first electrical connector 12 except that the housing of the first electrical connector 130 comprises keying features 132 extending from its bottom side. The second electrical connector 134 is identical to the second electrical connector 14 except for the following: 1. a guide 136 at the entrance to the slot 56, a guide projection 138 on the top side of the housing 32', the slide 36' is closed at its bottom side at area 140, the slide 36' has closed side rectangular guide slots 142 at its bottom side, and the housing 32' has generally rectangular projections 144 on its bottom side with L shaped slots 146 extending into the top side. The slots 146 form a receiving area for receiving the keying features 132 of the first connector 130. However, in alternate embodiments, any suitable keying features could be provided.

It should be understood that the foregoing description is only illustrative of the invention. Various alternatives and modifications can be devised by those skilled in the art without departing from the invention. Accordingly, the invention is intended to embrace all such alternatives, modifications and variances which fall within the scope of the appended claims.

What is claimed is:

1. An electrical connector comprising:

electrical contacts;

a housing having the electrical contacts connected thereto; and a mate assist system for assisting in mating the electrical connector to a mating electrical connector, wherein the mate assist system comprises a cam member and a user movable member, wherein the cam member is movably mounted to the housing and comprises first teeth and a caming surface for caming against a cam portion of the mating electrical connector, wherein the user movable member is longitudinally slidably mounted with the housing such that the housing and the user movable member are adapted to slide relative to each other in a substantially straight path, wherein the user movable member comprises a gear section with second teeth engaging the first teeth on the cam member.

2. An electrical connector as in claim 1 wherein the cam member is pivotably connected to the housing.

3. An electrical connector as in claim 2 wherein the caming surface is curved along its length.

4. An electrical connector as in claim 3 wherein the housing comprises a cam portion slot at least partially aligned with the caming surface of the cam member.

5. An electrical connector as in claim 4 wherein the cam portion slot is substantially straight.

6. An electrical connector as in claim 5 wherein the housing and the user movable member comprise a first latch system for retaining the user actuatable member at a first location on the housing and a second latch system for retaining the user movable member at a second location on the housing.

7. An electrical connector as in claim 6 wherein the housing comprises forward projecting members adapted to project into the mating electrical connector and move at least one shorting bar of the mating electrical connector.

8. An electrical connector as in claim 7 wherein the user movable member is slidably mounted to an exterior side of the housing for translation only movement on the housing.

9. An electrical connector as in claim 8 wherein the user movable member comprises an outer cover member surrounding a majority of the housing.

10. An electrical connector as in claim 1 wherein the caming surface is curved along its length.

11. An electrical connector as in claim 1 wherein the user movable member is slidably mounted to an exterior side of the housing for translation only movement on the housing.

12. An electrical connector as in claim 1 wherein the user movable member comprises an outer cover member surrounding a majority of the housing.

13. An electrical connector comprising:

electrical contacts;

a housing having the electrical contacts connected thereto; and a mate assist system for assisting in mating the electrical connector to a mating electrical connector, wherein the mate assist system comprises a cam member and a user movable member, wherein the cam member is movably mounted to the housing and comprises first teeth and a caming surface for caming against a cam portion of the mating electrical connector, wherein the user movable member is longitudinally slidably mounted with the housing such that the housing and the user movable member are adapted to slide relative to each other in a substantially straight path, wherein the user movable member comprises a gear section with second teeth engaging the first teeth on the cam member, wherein the housing comprises a cam portion slot at least partially aligned with the caming surface of the cam member.

14. An electrical connector as in claim 13 wherein the cam portion slot is substantially straight and the caming surface of the cam member is curved.

15. An electrical connector comprising:

electrical contacts;

a housing having the electrical contacts connected thereto; and a mate assist system for assisting in mating the electrical connector to a mating electrical connector, wherein the mate assist system comprises a cam member and a user movable member, wherein the cam member is movably mounted to the housing and comprises first teeth and a caming surface for caming against a cam portion of the mating electrical connector, wherein the user movable member is longitudinally slidably mounted with the housing such that the housing and the user movable member are adapted to slide relative to each other in a substantially straight path, wherein the user movable member comprises a gear section with second teeth engaging the first teeth on the cam member, wherein the housing and the user movable member comprise a first latch system for retaining the user actuatable member at a first location on the housing and a second latch system for retaining the user movable member at a second location on the housing.

16. An electrical connector comprising:

electrical contacts;

a housing having the electrical contacts connected thereto; and a mate assist system for assisting in mating the electrical connector to a mating electrical connector, wherein the mate assist system comprises a cam member and a user movable member, wherein the cam member is movably mounted to the housing and comprises first teeth and a caming surface for caming against a cam portion of the mating electrical connector, wherein the user movable member is longitudinally slidably mounted with the housing such that the housing and the user movable member are adapted to slide relative to each other in a substantially straight path, wherein the user movable member comprises a gear section with second teeth engaging the first teeth on the cam member, wherein the housing comprises forward projecting members adapted to project into the mating electrical connector and move at least one shorting bar of the mating electrical connector.

17. An electrical connector comprising:

a housing;

a plurality of electrical contacts connected to the housing;

a slide slidably mounted to the housing for translation movement of the housing and the slide relative to each other, wherein the housing and the slide are adapted to slide relative to each other in a straight path, and wherein the slide comprises a rack section with teeth; and a cam member pivotably mounted to the housing having a caming surface for receiving a cam portion of the mating electrical connector, wherein the cam member comprises a gear section with teeth engaging the teeth of the rack section.

18. An electrical connector comprising:

a housing;

a plurality of electrical contacts connected to the housing;

a slide slidably mounted to the housing for translation movement of the housing and the slide relative to each other, wherein the housing and the slide are adapted to slide relative to each other in a straight path, and wherein the slide comprises a rack section with teeth; and a cam member pivotably mounted to the housing having a caming surface for receiving a cam portion of the mating electrical connector, wherein the cam member comp rises a gear section with teeth engaging the teeth of the rack section, wherein the housing comprises forward projecting members adapted to project into a mating electrical connector and move at least one shorting bar of the mating electrical connector.

19. An electrical connector comprising:

a housing;

a plurality of electrical contacts connected to the housing;

a slide slidably mounted to the housing for translation movement of the housing and the slide relative to each other, wherein the housing and the slide are adapted to slide relative to each other in a straight path, and wherein the slide comprises a rack section with teeth; and a cam member pivotably mounted to the housing having a caming surface for receiving a cam portion of the mating electrical connector, wherein the cam member comprises a gear section with teeth en a in g the teeth of the rack section, wherein the slide comprises an outer cover member surrounding a majority of the housing.

20. An electrical connector comprising:

a housing;

a plurality of electrical contacts connected to the housing;

a slide slidably mounted to the housing for translation movement of the housing and the slide relative to each other, wherein the housing and the slide are adapted to slide relative to each other in a straight path, and wherein the slide comprises a rack section with teeth; and a cam member pivotably mounted to the housing having a caming surface for receiving a cam portion of the mating electrical connector, wherein the cam member comprises a gear section with teeth engaging the teeth of the rack section, wherein the housing and the slide comprise a first latch system for retaining the slide at a first location on the housing and a second different latch system for retaining the slide at a second location on the housing.

21. An electrical connector comprising:

a housing comprising forward projecting members adapted to project into a mating electrical connector and move at least one shorting bar of the mating electrical connector;

a plurality of electrical contacts connected to the housing;

a slide slidably mounted along an exterior side of the housing for translation movement of the housing and the slide relative to each other in a substantially straight path, wherein the slide comprises a rack section with teeth, wherein the slide comprises an outer cover member surrounding a majority of the housing; and a cam member pivotably mounted to the housing comprising a gear section and a slot, wherein the slot is adapted to receive a cam portion of the mating electrical connector, and wherein gear section comprises teeth engaging the teeth of the rack section.

22. An electrical connector as in claim 21 wherein the housing and the slide comprise a first latch system for retaining the slide at a first location on the housing and a second different latch system for retaining the slide at a second location on the housing.

* * * * *

UNITED STATES PATENT AND TRADEMARK OFFICE

CERTIFICATE OF CORRECTION

PATENT NO. : 7,462,047 B2
APPLICATION NO. : 11/803566
DATED : December 9, 2008
INVENTOR(S) : Tyler It is certified that error appears in the above-identified patent and that said Letters Patent is hereby corrected as shown below:

IN THE CLAIMS:

Claim 19, column 8, line 52, delete “en a in g” and replace with --engaging--.

Signed and Sealed this

Twelfth Day of May, 2009

JOHN DOLL
*Acting Director of the United States Patent and Trademark Office*